US006256951B1

(12) United States Patent
Findleton

(10) Patent No.: US 6,256,951 B1
(45) Date of Patent: Jul. 10, 2001

(54) LATERAL BRACING SYSTEM

(76) Inventor: J. Ronald Findleton, 1200 Brown Ave., Lafayette, CA (US) 94549

( * ) Notice: Subject to any disclaimer, the term of this patent is extended or adjusted under 35 U.S.C. 154(b) by 0 days.

(21) Appl. No.: 09/219,566

(22) Filed: Dec. 21, 1998

(51) Int. Cl.[7] ..... E02D 27/00

(52) U.S. Cl. ..... 52/250; 52/259; 52/295; 52/293.1; 52/274

(58) Field of Search ..... 52/167.3, 293.3, 52/295, 265, 289, 262, 167.1, 656.1, 260, 259, 250, 293.1, 274

(56) References Cited

U.S. PATENT DOCUMENTS

| | | | | |
|---|---|---|---|---|
| 3,055,460 | * | 9/1962 | Maroney | 52/293.3 |
| 4,251,965 | | 2/1981 | Power, Jr. . | |
| 4,716,695 | * | 1/1988 | Alexander et al. | 52/167.3 |
| 4,875,314 | | 10/1989 | Boilen . | |
| 4,924,648 | * | 5/1990 | Gilb et al. | 52/295 |
| 5,337,535 | | 8/1994 | Maupin . | |
| 5,375,382 | * | 12/1994 | Weidlinger | 52/167.3 |
| 5,390,455 | * | 2/1995 | Antolini | 52/299 |
| 5,448,861 | | 9/1995 | Lawson . | |
| 5,483,773 | * | 1/1996 | Parisien | 52/73 |
| 5,531,054 | | 7/1996 | Ramirez . | |
| 5,660,017 | * | 8/1997 | Houghton | 52/655.1 |
| 5,664,389 | | 9/1997 | Williams . | |
| 5,890,334 | * | 4/1999 | Hughes, Jr. | 52/299 |
| 5,983,590 | * | 11/1999 | Serban | 52/656.1 |

* cited by examiner

*Primary Examiner*—Christopher T. Kent
*Assistant Examiner*—Jennifer I. Thissell
(74) *Attorney, Agent, or Firm*—Theodore J. Bielen, Jr.

(57) ABSTRACT

A lateral bracing system for one or two story frame structures utilizing a sheet member having a first portion with first and second opposite edges spanning a pair of vertical supports in the structure. The sheet member includes a second portion which imbeds in the concrete foundation or pier. The sheet member may includes flanges to aid in the connection between the sheet member and the separated studs. The sheet member may extend from the foundation of the structure to the first and second stories of the structure to provide shear strength in the structure.

6 Claims, 3 Drawing Sheets

LATERAL BRACING SYSTEM

BACKGROUND OF HE INVENTION

The present invention relates to a novel bracing system for use in building structures.

Building structures employing vertical framing members, such as metal or wooden studs, have been strengthened to resist shear or lateral forces created by wind forces and/or seismic loading. In the past, such strengthening measures have taken the form of plywood shear walls fastened to the wooden or steel studs, held thereto by fasteners such as nails, staples bolts and the like. In addition, anchor bolts and hold downs have been employed to securely faster the frame structure to a foundation, such as a pier and grade beam foundation, a spread footing foundation a slab foundation, and the like.

Experience in actual earthquakes have shown that the combination of shear walls, composed of plywood, and nails are not sufficient to prevent damage to structures in this situation. It is believed that the estimated yield strength of nails normally used to transfer horizontal forces to a sill, ignores rotational forces. As a result, the stresses on nails in a typical shear wall may be as much as three to four times higher than their yield strength in a seismic event. It has been found that the ignoring of the vertical components from overturning moments in a frame shear wall has resulted in major structural failures during earthquakes.

Prior structures have been devised to reinforce buildings. For example, U.S. Pat. Nos. 4,875,314 and 5,448,861 show anchors which tie into the foundation of a building and extend upwardly therefrom through the use of tie rods.

U.S. Pat. No. 5,531,054 discloses a reinforced wooden wall in which foundation linked tie rods extend through the entire story of a building.

U.S. Pat. No. 5,664,389 shows a strengthening method against earthquake shock in which foundation reinforcing bars are linked to ceiling joists by special clamps.

U.S. Pat. No. 5,337,535 discloses a panel system in which the panels lock in side-by-side configuration to form wall ceilings and roof sections.

U.S. Pat. No. 4,251,965 describes a modular wall section which employs plates that extend between studs. The plates possess flanges that permit the plate to be fastened to the studs above the sill of the building.

A shear wall lateral bracing system which eliminates the need for foundation mounted tie downs and shear wall panels would be a notable advance in the building industry.

SUMMARY OF THE INVENTION

In accordance with the present invention a novel and useful lateral bracing system is herein provided.

The bracing system of the present invention is used in a building structure having based vertical supports or studs which may be wooden, steel, plastic, or any other suitable material. Generally, the building structure possess a concrete foundation which may be formed into a pier and grade beam type, spread footing type, and the like. The bracing element of the present invention utilizes a sheet member having a first portion with first and second opposite edges. The edges of the sheet member span the pair of separated vertical studs. A second portion of the sheet member extends into the particular concrete foundation. A number of separated sheet members may be employed in the structure and each may include a first portion having a flange angularly connected to the first edge, and a second flange angularly connected to the second edge. Fastening means of any suitable type may be used to hold the first and second flanges to a pair of studs. The first and second flanges may also be connected to the second portion of the sheet member and, thus, extend into the foundation concrete.

The sheet member may also reach upwardly from the floor of the building and through multiple stories thereof. Thus, the sheet member may include a third portion, connected to the sheet member first portion, which is fastened to a second story plate. In addition, the sheet member may extend upwardly to the ceiling of the second story of the building structure and be connected to separated studs in a similar manner to the connection of the first portion of the sheet member to the studs of the first floor.

Fastening means holds the third portion of the sheet member to the plate member by the use of straps, U-shaped braces, and the like. In this regard, the sheet member may include a fourth portion connected to the top transverse member or ceiling plate of the building structure. Thus, the bracing element of the present invention may extend to multiple stories and is perfectly compatible with steel or wood frames structures. In addition, lateral forces due to wind, earthquakes, and the like are met by the bracing element of the present invention without the need for shear walls, tie downs, anchor bolts, and the like.

It may be apparent that a novel and useful bracing element for use in a building structure is herein provided.

It is therefore an object of the present invention to provide a bracing element for use in a building structure which provides shear strength to meet lateral forces caused by wind or seismic loading.

Another object of the present invention is to provide a bracing element which is compatible with conventional vertical framing members used in building structures.

Another object of the present invention is to provide a bracing element for use in a building structure which eliminates the need for tie downs or hold downs in a concrete foundation.

A further object of the present invention is to provide a bracing element for use in a building structure which provides lateral strength without the need for shear wall material nailed to the vertical framing members.

A further object of the present invention is to provide a bracing element for use in a building structure which is capable of providing lateral strength to the structure through multiple stories.

A further object of the present invention is to provide a bracing element for use in a building structure which provides superior lateral strength in the building and is directly tied into the foundation structure of the building, thus, resisting vertical forces from uplift or gravity.

Yet another object of the present invention is to provide a bracing element for use in a building structure which is capable of resisting both vertical and lateral forces in concert.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments thereof which should be taken in conjunction with the prior described drawings.

Figure 1:
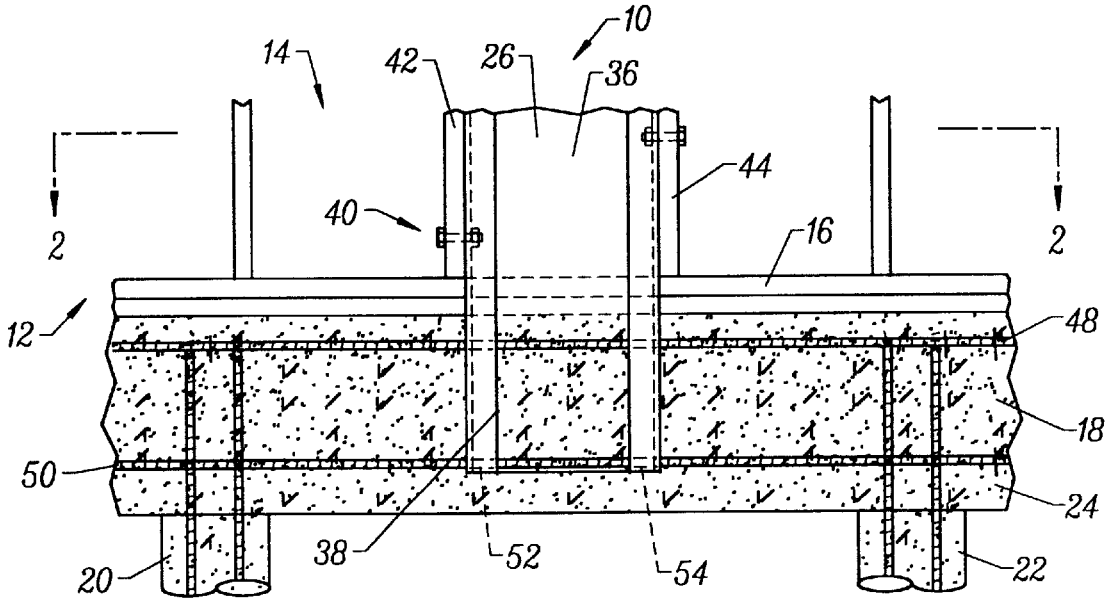
FIG. 1 is a sectional view showing the bracing element of the present invention imbedded in a concrete grade beam.
Figure 2:
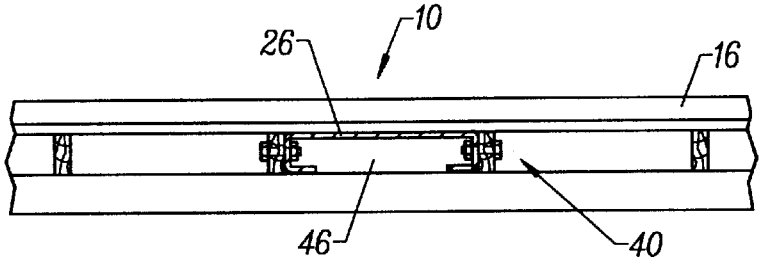
FIG. 2 is a sectional view taken along line 2—2 of FIG. 1.

The invention as a whole is depicted in the drawings by reference character 10. Bracing element 10 is employed in a building structure 12 having vertical framing members 14, a ground floor sill 16, and a concrete foundation structure 18. As shown in FIG. 1, foundation structure 18 includes piers 20 and 22 supporting grade beam 24. Sill 16 may be a single member instead of the dual members depicted in the drawings.

Figure 4:
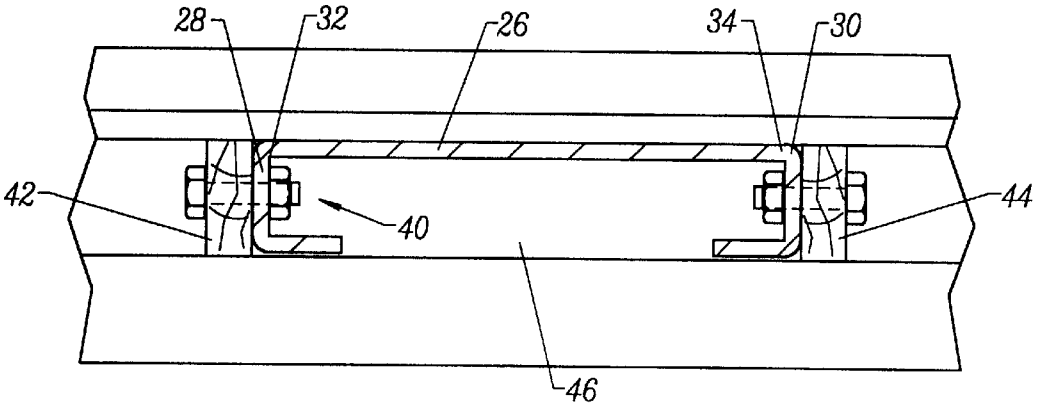
FIG. 4 is an enlarged sectional view of the central portion of FIG. 2 depicting the fastening members.

Bracing element 10 includes as one of its elements a sheet member 26 which may be a uniform sheet of metallic material, such as steel. Typically, 10 or 12 gauge sheet steel may be employed as sheet member 26. A pair of flanges 28 and 30 connect to edges 32 and 34 of sheet member 26. As depicted in FIG. 4, such inner connection is a contiguous structure. Returning to FIG. 1, it may be observed that bracing element 10 includes a first portion 36 extending above sill 16, and a second portion 38 embedded in the concrete of concrete foundation 18.

First portion 36 extends upwardly from the sill 16 and includes fastening means 40 for holding bracing element 10, specifically holding flanges 28 and 30 to studs 42 and 44. Such connection forms an open chamber 46 between sheet member 26 and flanges 28 and 30 connected thereto. Chamber 46 may be employed to hold insulation material and the like in the normal fashion.

Second portion 38 of bearing member 10 embedded in concrete foundation 18 and, thus, becomes a composite section. Second portion 38 of bracing element 10 is completely compatible with reinforcing bar members 48 and 50. In fact, flanges 28 and 30 of bracing element 10 may be formed with openings to permit rebar members 48 and 50 to pass therethrough. For example, openings 52 and 54 in flanges 28 and 30, respectively permits rebar 50 to pass therethrough.

Figure 3:
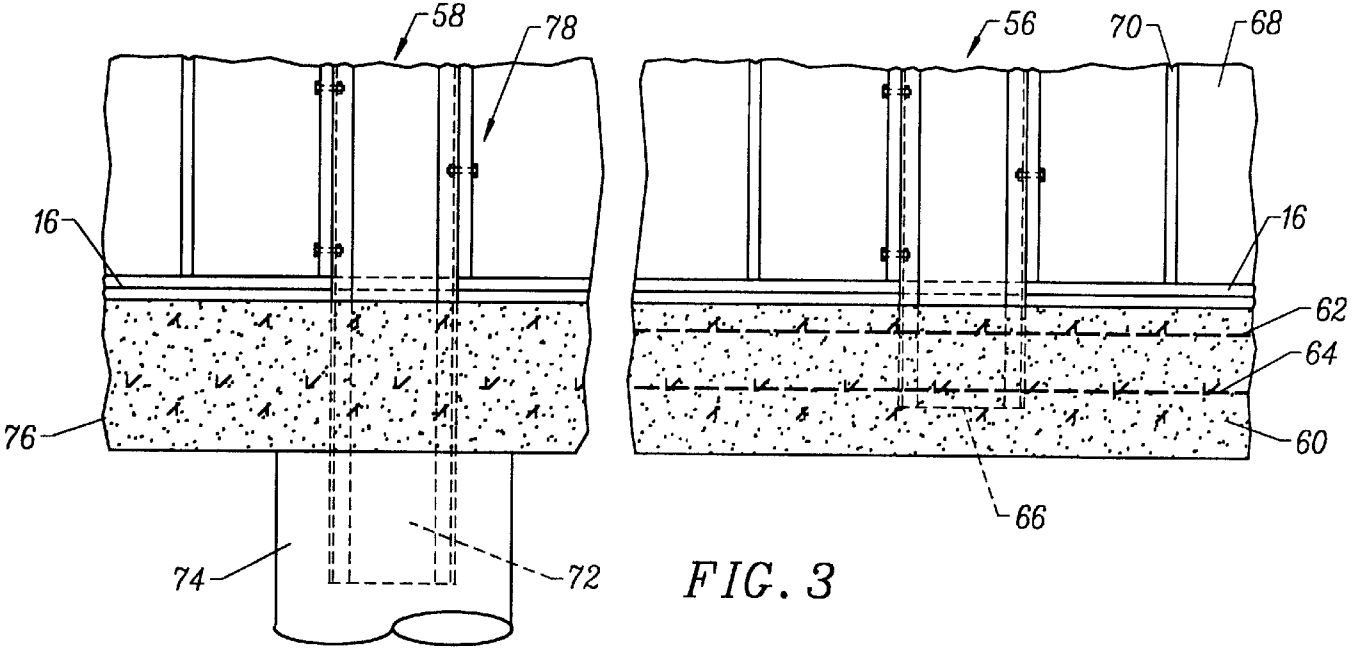
FIG. 3 is a sectional view showing alternate foundation structures using the lateral bracing element of the present invention.

Turning to FIG. 3, it may be observed that bracing members 56 and 58 are shown, with foundations of various types. For example, bracing member 56 is used in accordance with a foundation wall 60, that may be a grade beam. Reinforcing bars 62 and 64 act in concert with second portion 66 in the same manner as second portion 38 of bracing element 10 of FIG. 1. Bracing members such as bracing member 56 may be used along sill 16 and, preferably, not at the space formed between each and every vertical framing member. Thus, bracing element 56 may be repeated at space 68 adjacent stud 70, although it is not depicted as such in FIG. 3.

With respect to bracing member 58, second portion 72 extends directly into pier 74 without the need for engagement with a metal cage. It has been found that bracing member 58 provides the necessary strength to tie pier 74, to foundation wall 76, and the remaining part of building structure 12. Second portion 72 may extend into pier 74 to the required depth to provide reinforcement to pier 74.

Fastening means 40 is shown in the drawings as a plurality of nuts and bolts 78. However, any fasteners may be employed in this regard including staples, ramsets nails, adhesives, and the like. Plurality of nuts and bolts 78 are also depicted as being staggered in a vertical direction from sill 16, upwardly.

Figure 5:
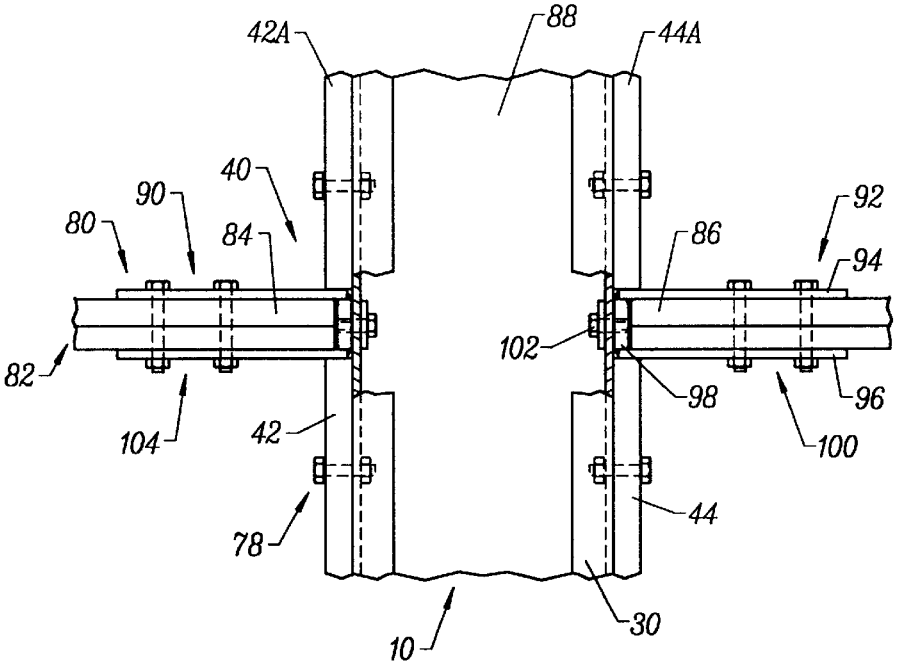
FIG. 5 is a sectional view depicting the extension of the bracing element of the present invention through the plate of the second story of a building.
Figure 6:
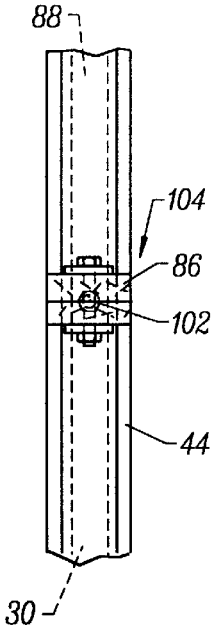
FIG. 6 is a right side view of the inner connection depicted in FIG. 5 with the plate in section.

Viewing now FIGS. 5 and 6, bracing member 10 is shown in its extension to a second story floor 80 of building structure 12. Plate 82 has been divided into two sections 84 and 86. Bracing element 10 includes a third portion 88. Fastening means 40 further includes a structure which connects third portion 88 of bracing element 10 to the plate 82 of the second floor of building structure 12. It may be observed, connecting structures 90 and 92 are depicted with respect to studs 42 and 44. Second story studs 42A and 44A serve as a virtual extension of studs 42 and 44 of the first story of building structure 12. In this regard, the description with respect to connecting structure 92 also serves to identify the particular elements of connecting structure 90. Connecting structure 92 possesses straps 94 and 96 which are welded to a vertical plate 98 to form a U-shaped member 100. Fastener 102 sandwiches third portion 88 of bracing element 10 between fastener 102 and plate 98 of U-shaped member 100. A similar structure may be found with respect to connecting structure 90, which is the mirror image of connecting structure 92. Plurality of fasteners 104 hold connecting structures 90 and 92 to plate sections 84 and 86, respectively. Plurality of fasteners 104 are employed with respect to structures 90 and 92 to sandwich structures 90 and 92 to plate sections 84 and 86.

Figure 7:
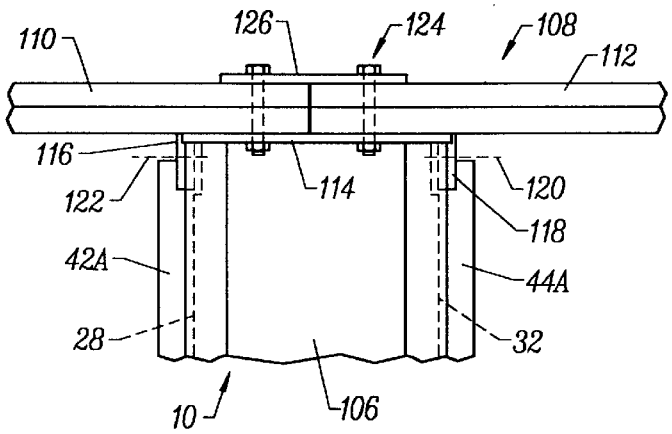
FIG. 7 is a side elevational view of the meeting of the bracing element of the present invention with the top transverse member of a building.
Figure 8:
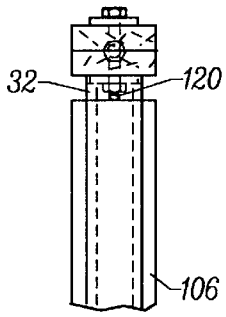
FIG. 8 is a right side view of the relationship depicted in FIG. 7, with the plate in section.

Turning now to FIGS. 7 and 8, it may be observed that brace member 10 includes a fourth section 106 which extends to the top transverse member or plate 108 of building structure 12. Again, plate 108 is split into two sections 110 and 112. Bracing member 10 is fastened to plate 108 by the use of U-shaped member 114 and is held to flanges 28 and 32 of bracing member 10 by plates 116 and 118. Fastener 120, FIG. 8, is depicted schematically on FIG. 7 along with another fastener 122, employed with respect to flange 28. Plurality of fasteners 124 hold U-shaped strap 114 to a top plate 126. Thus, bracing element 10 may be employed to support a vertical load in certain cases. Of course, studs 42A and 44A may extend upwardly into contact with top plate 108, if desired.

In operation, the user places bracing element 10 within the foundation 18 of building structure 12, be it a concrete slab, a spread footing, or a pier and grade beam type construction. In the case where piers are employed, bracing members of the present invention, such as bracing member 58, may extend directly into pier 74 obviating the need for a cage interconnection. In other cases, bracing members such as bracing member 56 will be tied to reinforcing bars 62 and 64 of a foundation wall 60, FIG. 3. Bracing element 10 extends upwardly from foundation 18 and is interconnectes with vertical members such as studs 42 and 44 by the use of plurality of fasteners 78. Plurality of fasteners 78 are staggered upwardly toward the second story of building structure 12. All bracing elements used in building structure 12, such as bracing element 10, include a third portion 88 which interconnect with the plate 82 of the second story of building structure 12. Such interconnection may take the form of connecting structures 90 and 92 delineated in FIG. 5. Lastly, exemplary bracing element 10 continues upwardly to top plate 108 of building structure 12 and is interconnected thereto by the use of U-shaped straps 114, plates 116 and 118, as well as top plate 126 by the use of fasteners, such as plurality of fasteners 124 and fasteners 120 and 122. It has been found, that bracing element 10 provides superior lateral support to a building structure and obviates the need for plywood shear walls used in the prior art.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A bracing system for use in a building structure having a pair of separated vertical studs; comprising:

a. a concrete foundation supporting the pair of separated vertical studs;

b. a sheet member having a first portion with first and second opposite edges intended for spanning the pair of separated vertical studs, and a second portion, said second portion embedded in said concrete foundation;

c. a first flange angularly connected to said first edge of said sheet member first portion;

d. a second flange angularly connected to said second edge of said sheet member first portion; and e. fastening means intended for holding said first flange to the building structure at the first stud and intended for holding said second flange to the building structure at said second stud.

2. The bracing system of claim 1 in which the building structure further includes a plate member oriented laterally relative to the first and second studs, said plate member located above said concrete foundation, and said sheet member further comprises a third portion connected to said sheet member first portion and intended for connection to said plate member, said fastening means further comprising means for holding said third portion of said sheet member to said plate member.

3. The bracing system of claim 2 in which said means intended for holding said third portion of said sheet member to said plate member includes a U-shaped strap at least partially encompassing said plate member, and a fastener securing said U-shaped member to the third portion of said sheet member.

4. The bracing system of claim 3 in which the building further includes a top transverse member oriented laterally relative to the first and second studs, the top transverse member located above the said third portion of said sheet member, and said sheet member further comprises a fourth portion connected to the sheet member third portion, and said fastening means further comprises means intended for holding said fourth portion of said sheet member to the top transverse member.

5. The bracing system of claim 4 in which said fastening means further comprises a strap intended for connecting said fourth member to the top transverse member.

6. The bracing system of claim 1 which further comprises a reinforcing bar in said concrete foundation and an opening in said first flange for permitting the passage of said reinforcing bar.

* * * * *